United States Patent [19]

Jordan

[11] Patent Number: 4,459,117

[45] Date of Patent: Jul. 10, 1984

[54] LIQUID JET PROPULSION

[76] Inventor: Robert L. Jordan, Star Rte., Box 665, Klamath, Calif. 95548

[21] Appl. No.: 967,790

[22] Filed: Dec. 8, 1978

Related U.S. Application Data

[63] Continuation-in-part of Ser. No. 790,256, Apr. 25, 1977, abandoned.

[51] Int. Cl.[3] ..... B63H 11/08

[52] U.S. Cl. ..... 440/38; 415/143; 415/199.2; 415/206; 416/183; 440/47; 440/48; 440/88; 440/89

[58] Field of Search ..... 416/183; 415/143, 199.2, 415/206; 60/221, 222; 440/38, 47, 48, 88, 89

[56] References Cited

U.S. PATENT DOCUMENTS

| | | | |
|---|---|---|---|
| 2,942,556 | 6/1960 | Growall | 415/206 |
| 3,082,732 | 3/1963 | Stallman | 115/12 A |
| 3,105,353 | 10/1953 | Schulz | 115/12 A |
| 3,146,587 | 9/1964 | Then | 60/222 |
| 3,187,190 | 6/1965 | Lang | 415/206 |
| 3,200,754 | 8/1965 | Burgin | 440/47 |
| 3,522,997 | 8/1970 | Rylewski | 415/143 |
| 3,723,019 | 3/1973 | Berman | 415/143 |
| 4,093,401 | 6/1978 | Gravelle | 415/143 |

*Primary Examiner*—Sherman D. Basinger
*Attorney, Agent, or Firm*—John L. McGannon

[57] ABSTRACT

The liquid jet propulsion unit is driven by the conventional outboard motor. The drive of the motor directly rotates an impeller which draws up the water into an impeller chamber where it is moved by isentropic radially extending impeller blades. These blades have three progressive stages from inlet to outlet, i.e., axial, transition, and radial. In the delivery of the intake liquid to the outlet chamber the twisting turbulence is reduced and is straightened out and is further straightened by the outlet vane to give a stream greater lineal length and force through the outlet nozzle, which drives the craft forward. Since the vertical distance between intake and outlet is only a matter of a few inches, shallow draft boats can be driven successfully in shallow and rocky water.

7 Claims, 18 Drawing Figures

LIQUID JET PROPULSION

This is a continuation-in-part of Ser. No. 790,256 filed Apr. 25, 1977 and now abandoned.

BACKGROUND OF THE INVENTION

The field of this invention relates to liquid propulsion units of the jet type, particularly useful for shallow draft boats, using outboard motors of 18 horsepower and under.

In the prior art there are a few units of this type, but each has specific problems which not only greatly reduce the operative results, but also add to the expense of manufacture and installation. Furthermore, since units of this type are useful in connection with fishing or other propulsion requirements in the shallower rivers and lakes, it is necessary for the unit to operate and be controlled within very narrow limits in order to fulfill the desired uses and purposes.

Many of the units proposed are so extensive with respect to vertical space requirements, that they project below the keel line or bottom of the boat to which they are to be attached and thus restrict the use to deeper waters than desired.

The unit of the present invention is so simplified that it will not occupy any space below the keel line or bottom of the boat, and so will operate in any water deep enough to permit the passage of the boat itself, and its intended carrying load.

The device of the present invention rectifies many of the disadvantages of the prior art devices. One of the great advantages of the present invention is that it can perform efficiently when coupled to low horsepower existing motor units.

SUMMARY OF THE INVENTION

The nature of the present invention is the production of a unit performing liquid jet propulsion drive which, after removal of the propeller and its gearing may be readily attached to the vertical drive shaft at the lower portion of existing outboard motors. The liquid jet propulsion is designed to replace the propeller drive portion of such outboard motors, or any other vertical drive unit. The efficiency and usefulness at low horsepowers appears at the present time to be a function of the shape of the intake chamber and the blades of the impeller. This coupled with the positive flow and the exhaust from the chamber gives the unit the capabilities which are claimed and which are to be described herein.

It is to be remembered that any embodiment which raises the operating efficiency of a low horsepower operation even one unit will raise a high horsepower unit a corresponding improvement.

The safety of the present unit is exceptional in that in operation it may be handled without any danger to the operator or adjacent persons. Furthermore there is nothing to snag or contact, especially in rocky bottoms where contact would put the unit out of commission and leave the operator stranded.

A further advantage is that the cost of the unit is substantially less than any prior art units and operates with far greater efficiency and work results, than have heretofore been obtained by any jet unit.

A still further advantage is that there are no pollutants discharged from this unit below the water line. This, however, does not change the pollutants which are discharged by the motor. Fishermen and sportsmen of all kinds, are very conscious of environmental pollutants and are quick to demand that any device used in their pursuits do not contribute further polluting emissions which would ultimately destroy the pleasure that they receive in excercising their fishing or other pursuits.

Amongst the unexpected results attained by the present invention is the discovery that by having the suction, or the water intake, larger than the diameter of the outlet, the drawbacks of implosion are substantially eliminated as well as producing a greater and better directed forward thrust.

Another great advantage of the present invention and certainly an unexpected result, is that the smoothness and velocity of the discharge at the top of the intake chamber is improved as the result of a negative dihedral at the top portion of the blades of the impeller. The term negative dihedral as herein used is intended to mean the angular relation between the vertical portion and the helical portion of each blade and the facing of the vertical portion of the blade relatively to the axis of rotation. It has been found by further study that this negative dihedral provides a greater horsepower utilization, therefore, it makes the lower horsepower drive units feasible which was not heretofore either expected or understood. The negative dihedral directs the water which is sucked into the intake chamber to the compression chamber and into the exhaust with minimum turbulence and better directional flow than has been previously understood or claimed.

Further objects are to provide a construction of maximum simplicity, economy and ease of assembly and disassembly, also such further objects, advantages and capabilities as will fully appear and as are inherently possessed by the device and invention described herein.

The invention further resides in the combination, construction and arrangement of parts illustrated in the accompanying drawings, and while there is shown therein a preferred embodiment thereof, it is to be understood that the same is illustrative of the invention and that the invention is capable of modification and change and comprehends other details of construction without departing from the spirit thereof or the scope of the appended claims.

DESCRIPTION OF THE PREFERRED EMBODIMENTS

Figure 1:
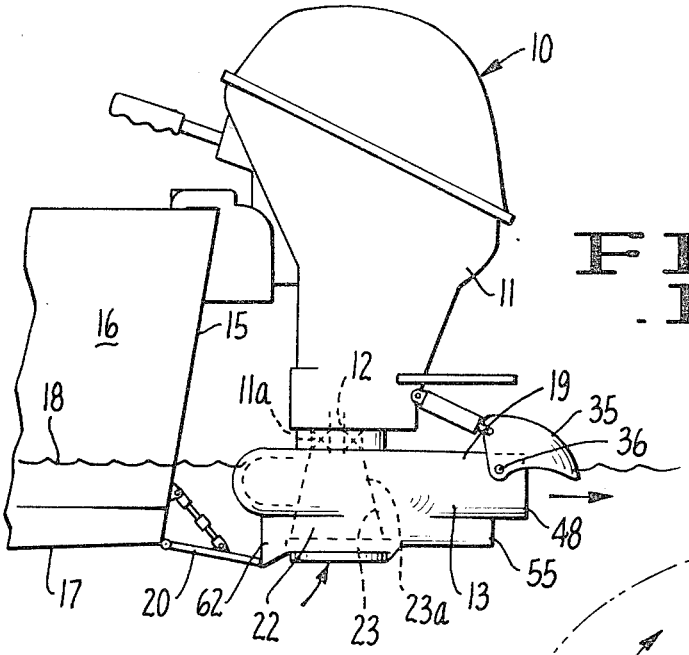
FIG. 1 is a side elevation of a standing outboard motor with the jet propulsion means of this invention attached thereto, all attached to the transom of a boat shown in fragment.
Figure 3:
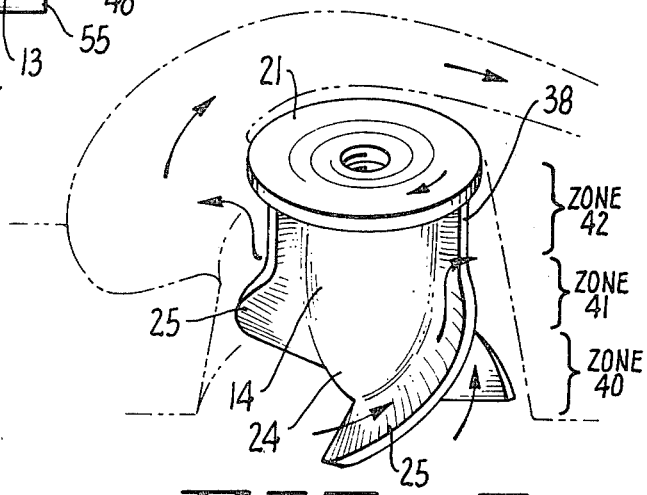
FIG. 3 is a perspective view of an impeller.

Referring now more particularly to the drawings in which like reference numerals indicate like parts of the several views, there is indicated generally at 10 in FIG. 1 the side elevational view of a complete power unit as attached to the stern of a small boat. This consists of a conventional outboard power unit 11 from which the propeller and its gearing have been removed so that the power shaft 12 is available for attachment of the driving means. The driving means in this instance is the liquid jet propulsion unit 13 of the present invention.

The power unit 11 is secured to the transom 15 of a boat 16 in the conventional manner of outboard motors. As is customary the boat 16 is provided with a keel 17. The displacement of the boat 16 and the attached drive unit 10 without load, represents the distance from the keel 17 to the waterline 18. It is to be noted that the lower extension of the jet propulsion unit and the keel are approximately the same so that the operational water depth is substantially that of the displacement. A spacer 20 may be used to space the unit 10 from the propulsion unit 13, which provides a crescent shaped cutout to loosely receive and align the curved front end of the propulsion unit 13.

Projecting downwardly from the housing 10 is a power shaft 12 which is keyed or attached in any suitable manner to the impeller 14 which is driven or rotated thereby. The power shaft is journaled at 11*a* in the housing 13 in any suitable manner for smoothly rotating the impeller 14.

The impeller 14 rotates within a chamber 22 of the housing 13 and shown in the drawings as a truncated cone with the larger diameter at the inlet or lower portion 23 and the smaller diameter at the outlet or upper portion 23*a*. In the form shown in FIG. 8 the impeller 14 has a top plate 21 which maintains the position of the impeller within the chamber 22 with a minimum of wear and prevents wobble during rotation. The impeller 14 has a bullet shaped hub 24 preferably, with the point thereof centered in the inlet portion 23 of chamber 22 and has a plurality of blades 25.

Figure 9:
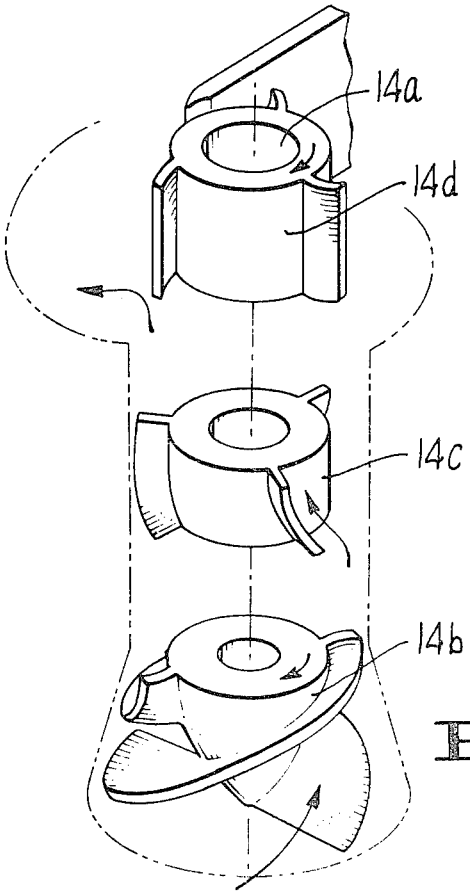
FIG. 9 is an exploded perspective view of a multi-stage impeller.

As shown in the top section of FIG. 9, the top of the impeller 14 may be formed without the top plate. The hollow interior 14*a* of the top portion receives the power shaft 12 which is secured in turn in the nose portion 24. It will be observed that the same result of stability in rotation is accomplished in both forms.

One of the chief factors which makes this structure new and operable is the impeller 14. The blades 25 are of unusual shape and form, and it is these unusual shapes and forms which produce the very unexpected operational results.

Figure 7:
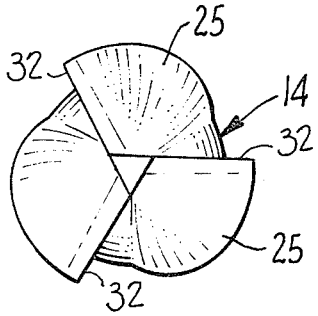
FIG. 7 is a bottom plan view of said impeller.
Figure 16:
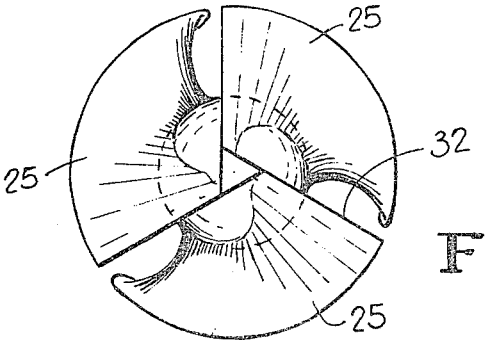
FIG. 16 is a bottom plan view on lines 16—16 of FIG. 15.

Assuming a three (3) bladed impeller, it will be seen from FIGS. 2, 3, 6 and 7 that at the base of each blade the distance from the point of intersection with the hub to its outermost point, which is substantially the width of its operating face, is greater than one half of the diameter of the inlet 23 to chamber 22 due to the offset oppositely to the axis of rotation of the impeller. This offset is shown in FIGS. 7 and 16, namely, the radial leading edges 32 intersect at points spaced from the axis of rotation thereby producing the offset of the leading edges 32. This means that the impeller will attempt to take into the chamber 22 more water than can be put through the outlet portion, thus creating substantial pressure in the chamber. Each blade 25 for a distance of approximately $\frac{1}{3}$ of the height of the axis of the hub (see FIG. 3 zone 40), is in a true helix having a radial rake of approximately negative five (5°) degrees. The pitch angle of the blades in this lowest zone 40, takes into consideration the horsepower requirements of the motor in a direct relationship. As a result of this rake each blade 25 has an intake force greater than that for one-half on the intake 22 diameter. In the next or median zone 41, the curves of the blades 24 create a transitional phase. In this zone 41 the blades begin a generation of curves that will transpose the twisting flow of the positive axial rake to approximately 0. In the upper zone 42, the rake changes to a high negative dihedral 38 that will convert the upward turbulence and change the hydraulic force to linear force adjacent the perimeter. In zone 42 it will be observed that the reverse dihedral is just about zero. The less the dihedral the less horsepower it takes to achieve optimum results. For example with the dihedral shown in FIG. 3, at 18–20 horsepower it will provide 68,000 c. inches per minute, the velocity as it leaves the outlet nozzle 68. This will move the liquid at approximately 60 m.p.h. In this manner the negative dihedral shape 38 at the top of the impeller will direct the straight line flow or force to the outlet opening of the chamber 22 and cause the flow to follow to the point of its greatest force at the cutoff point into the outlet channel in the housing 19. It is the negative dihedral adjacent the top of the impeller blade which is one of the features which gives the unit its superior operating characteristic.

Figure 4:
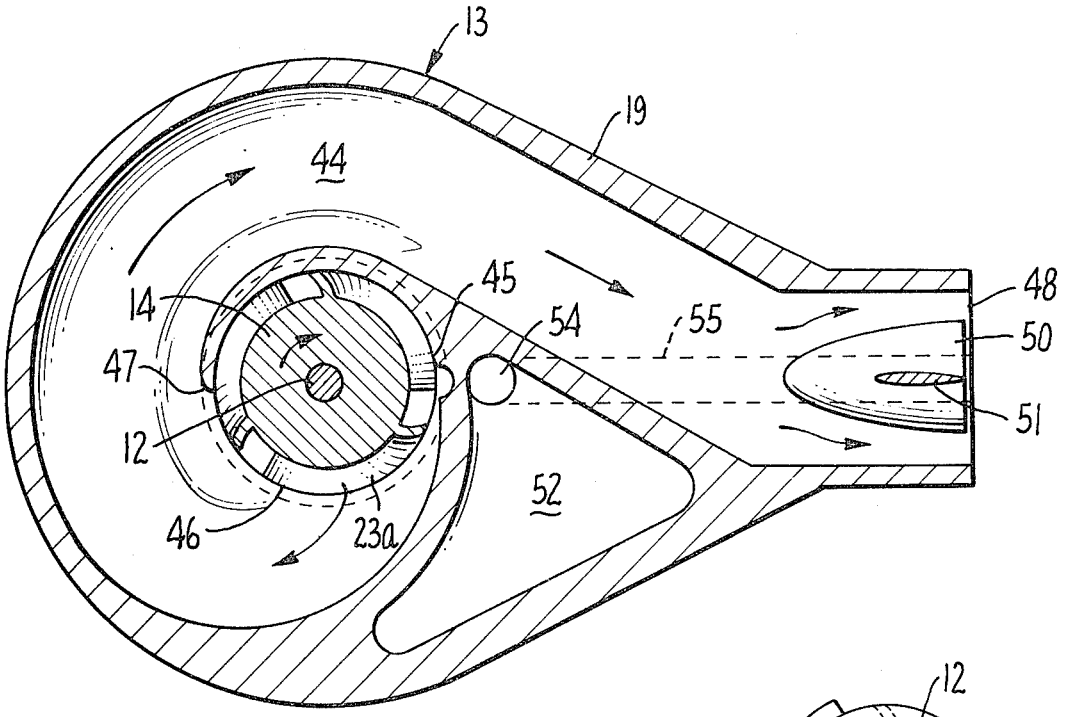
FIG. 4 is a transverse section taken on the line IV—IV of FIG. 2 looking in the direction of the arrows.
Figure 6:
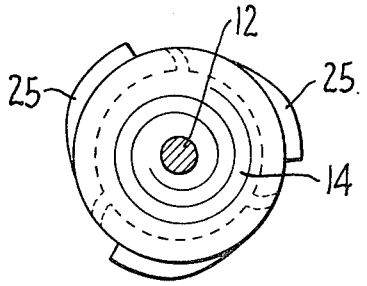
FIG. 6 is a top plan view of the impeller shown in FIG. 3.

As has been indicated above, the impeller 14 is received within the chamber 22 of a housing 19 which has been generally designated 14. In the views shown in FIGS. 4 and 5, the housing 19 is generally pear shaped although the shape is not in any way indicative of the operation or the required structure thereof, but is merely stated for purposes of identification. For purposes of fabrication, the housing 19 is preferably cast in two sections cut horizontally approximately at the mid section shown by the line IV—IV of FIG. 2. FIG. 4 shows the lower half and the upper half is substantially the identical form in reverse, with the exception that the upper half forms the top closure to the chamber 22. Looking at FIG. 4 it will be observed that at the zone 42 of the impeller there is a convolute channel 44 on the interior thereof, the outer wall of which commences on the internal side just above the vertical median line as indicated at 45. At this point the wall of the outlet 23*a* of the truncated cone chamber 22 joins the convolute leaving an opening 46 from the chamber into the convolute channel 44. The inner wall of the outlet 23*a* extends upwardly at 47 to close the opening, and for purposes of reference point 47 is determined as the point of greatest force. After point 47 the convolute 44 channel becomes a closed passageway and leads in a clockwise direction toward the outlet for the flow of the unit, which is designated 48. Various devices may be used to secure increased velocity at the outlet 48 and to further straighten the flow linearly and increase its force. For instance, a streamlined bullet like vein or plug 50 may be inserted in the outlet 48 supported in rigid position by streamlined supports 51.

It will also be observed that there is an irregular triangular shaped cavity 52 which has a vertical inlet 53 and an oppositely disposed outlet 54. The purpose of this will be discussed in the operational features. It is apparent that the upper casting for the housing 19 has a mating section forming the closure for the cavity 52. The outlet 54 extends downwardly and then longitudinally through the housing 19 to its exhaust 55 which is vertically aligned just below the main outlet 48.

Figure 2:
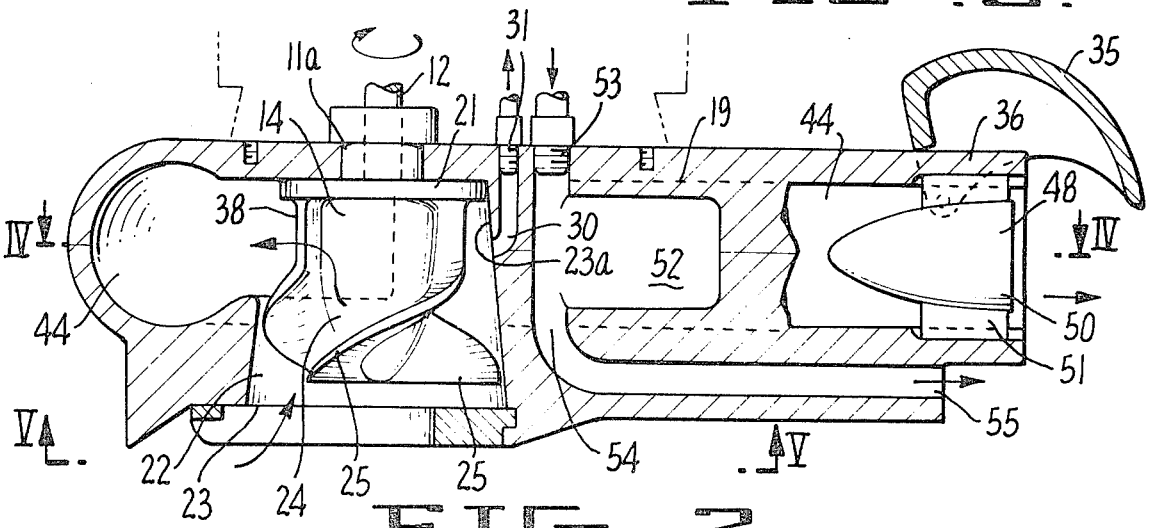
FIG. 2 is a vertical section of the jet propulsion means disclosed herein.
Figure 5:
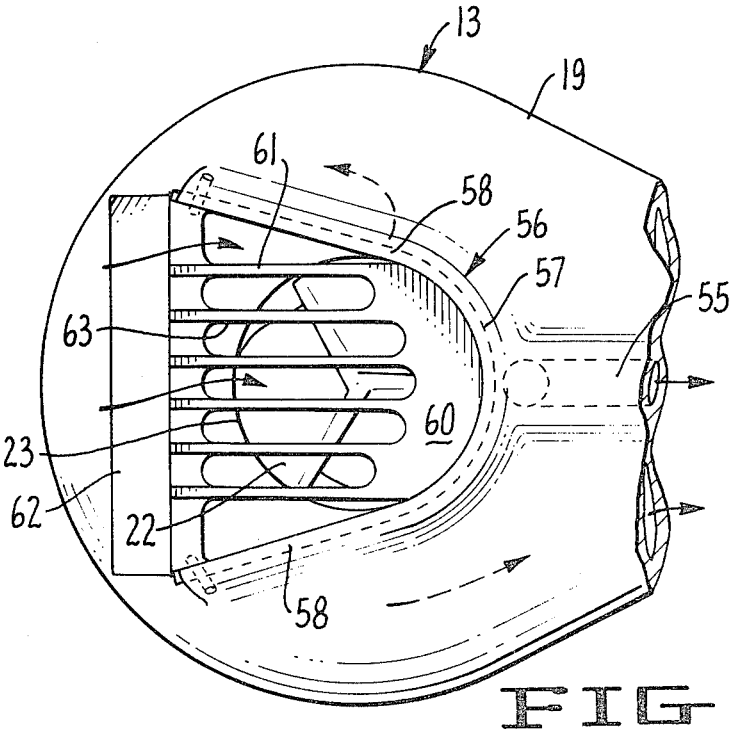
FIG. 5 is a bottom plan view taken on the line V—V of FIG. 2.

Looking at FIG. 5 which is a bottom plan view, the housing 19 in this form shows the housing 19 in its relationship to the inlet 23 to the chamber 22. The housing has a U-shaped opening 56 with the closed curved portion 57 following the curve of the opening 23 to the chamber 22. The legs 58 of the U 56 widen apart angularly at a point just before the transverse diameter of the opening 23. This U-shaped opening to the chamber 22 is protected by a cover plate 60 which fits by spring locking within the U-shaped opening and is formed with louvered (61) openings 63 which act as a strainer but permits water to enter into the chamber 22. This is a removable cover and is locked in position in any suitable manner. As shown in FIGS. 2 and 5 the casting has a transverse ridge portion 62 which presents a solid bar directly protecting the louvers 61 and the opening to the chamber 22.

The impeller shown in FIGS. 13 through 17 illustrates in more detail the angle of the vertical blade portions relatively to the helical portions of the blades and the axis of rotation of the impeller.

Figure 13:
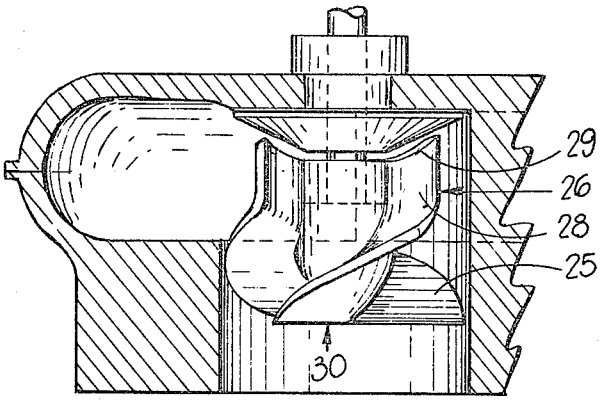
FIG. 13 is a fragmental, sectional view showing the impeller in position.
Figure 17:
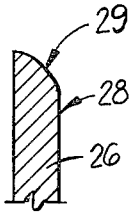
FIG. 17 is a fragmental sectional view on lines 17—17 of FIG. 15.
Figure 14:
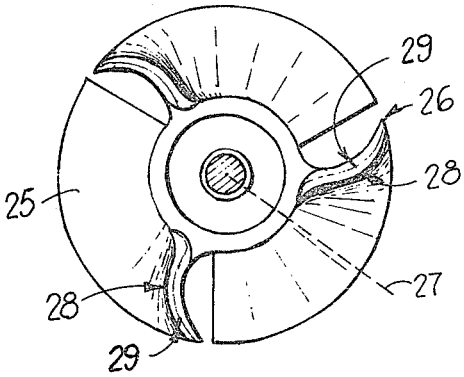
FIG. 14 is a top view of an impeller, viewing on lines 14—14 of FIG. 15.
Figure 15:
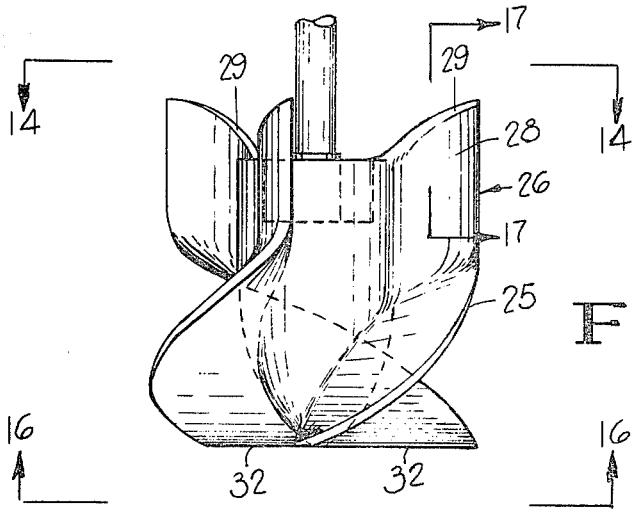
FIG. 15 is a side view of the impeller.

Each vertical blade portion 26 is generally parallel with the axis of rotation of the impeller and extends generally at an acute angle to the radial plane 27, indicated by broken lines in FIG. 13, oppositely to the direction of rotation of the impeller. The vertical blade portion 26 is curved cross-sectionally oppositely to the direction of rotation of the impeller so as to present its convex face 28 toward the direction of rotation of the impeller for expelling the water generally radially.

In the form shown in FIGS. 13 through 17, the top edge of each vertical blade portion is inclined toward the convex blade face 28 so as to form a reverse top edge face 29 toward the direction of rotation and further direct water radially and inhibit whirling of water at the top of the impeller.

OPERATION

Assuming a 15 horsepower Mercury outboard motor, the conventional propeller and its operating assembly are removed leaving the power drive shaft 12 exposed, the housing assembly 13 is attached to the power drive shaft 12 by receiving the same in the impeller 14. The relatively light weight of the assembly 13 is secured to the housing of the motor unit 11 in any suitable manner. The completely assembled unit 10 is then placed on the boat 16 in the conventional way. The unit 10 is secured at the top portion but to add stability to the power unit but without interfering with maneuverability, a hinged spacer 20 is dropped into position to bear against the curvature of the forward portion of the power unit adjacent its lower end, as shown in FIG. 1.

In the water, as will be seen in FIG. 1, the housing 19 is below the waterline 18, but very close thereto. No part thereof extends below the line of the keel 17 of the boat 16. Thus the power unit can go in any depth of water displaced by the boat and its load, without damage to the power unit. It will also be observed that no oil or fuel using parts are below the waterline 18 so there is no water contamination by the operation of this equipment.

When the motor is started, assuming the r.p.m. established by the manufacturer of the 15 hp. motor is within the range of 4,000 to 5,200 r.p.m. and that peak performance for optimum efficiency is at 5,200 r.p.m., with one person aboard, it is reasonable to achieve speeds up to 27 m.p.h. The operation, when the impeller 14 is rotated by the motor is as follows:

The helix in zone 40 of the impeller 14 will tend to draw water into chamber 22 through the screening grid 60, more water than can be discharged at the upper zone 42. This is because the leading edge of the helix, as before stated, has a greater linear distance than the radius of chamber 22, due to the radial offset. The rotary turbulence in the intake water produces entrained air bubbles which are compressible, with the result that unless this air is eliminated or removed, there will be a substantial loss in power at the outlet. These air bubbles produce implosion within the chamber 22. Such a phenomenen is a constant destructive force so far as power is concerned, and in the present operation such is minimized by taking in more water than is or can be released at the nozzle and by delivering the flow to a channeled outlet in substantially a linear flow. The liquid in zone 40 is twisted in the turbulence and wrapped around the impeller, much the same as ordinary rope. The compression due to excess liquid minimized the influence of implosion.

When this twisting flow enters the transition zone 41 the purpose is to begin the untwisting and to calm the turbulence. In zone 42 the negative dihedral further straightens the flow and delivers it in a linear flow to the delivery channel 44 through the opening 46. The linear force in the convolute channel 44 appears to be maximized at the cutoff edge 47 from the chamber 22. The cutoff edge 47 is also at right angles to the axis of flow at this point and at the beginning of the straight run through channel 44. The negative dihedral of the blades in zone 42 directs the water flow through the channel 44 to the exhaust or delivery nozzle 48. The twist of the flow is also converted to linear force at the cutoff point 47 and further straightened by the directional guide 50. The untwisting and straightening increases the force of the flow at the discharge nozzle 48.

As before described the chamber 22 is in the shape of a truncated cone with the blade shape wider at the vertical intake than at the negative dihedral of the outlet. This form is best suited for smaller horsepower motors up to approximately 18 horsepower, but can be used in larger horsepowers as well.

However, for the larger horsepowers the walls of the chamber are straightened vertical sides in zones 41 and 42 as at the higher horsepowers more force is required to drive the water into the compression portion in zones 41 and 42. The negative dihedral portion 42 may be provided with blades wider than the blades at the bottom of the impeller at the entrance to the chamber.

This, of course, requires modification of the chamber to permit operation of wider blade portion in the negative dihedral zone 42.

There are other features of operation in this unit. The engine exhaust is brought through line 53 to exhaust chamber 52 where it expands and then passes on through outlet line 54 where it is discharged through exhaust 55. The curved side walls of this chamber 52 unexpectedly reduce noise and pressure of the exhaust and make the operation unusually quiet.

Furthermore, since there is always an excess of water in chamber 22, a portion thereof may be circulated as cooling water for the motor. This may be taken off at point 30, and thence through line 31 for direct connection with the cooling water intake for the motor. This does away with the necessity for water pumps which are a constant source of trouble, repair and replacement, as well as providing a decided advantage in operation. This is accomplished without any damaging effect upon the force of the flow from zone 42.

In order to make this jet propulsion unit fully operable a reversing means is provided. A hollow cup-shaped member 35 is hinged at 36 adjacent the exhaust nozzle 48. The cup is somewhat claw shaped and when dropped downward to the reversing position it extends below the nozzle opening, covering but not closing the exhaust nozzle 48. In this manner the jet force is directed against the inside of the cup and its shape directs the flow downwardly and counter to the nozzle flow. Although the thrust of the flow is slightly reduced, it is not sufficient to cause any noticeable drop in efficiency.

MODIFIED STRUCTURE

Figure 10:
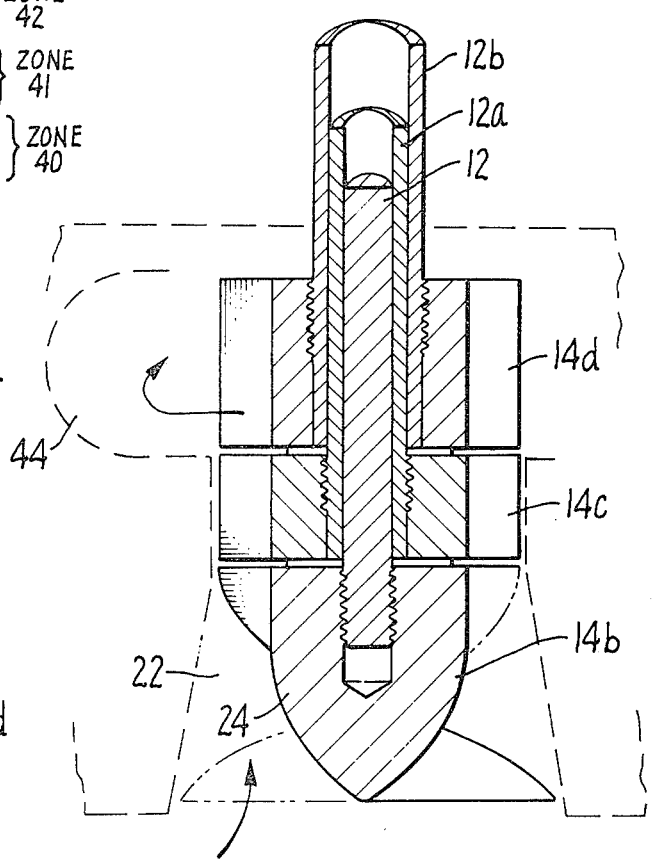
FIG. 10 is a vertical section of the multi-stage impeller with drive.

The multi-stage structure is shown in FIGS. 9 and 10, and essentially the operating characteristics are the same as for the single stage. However, the impeller 14 has been divided into three separately functioning zones by the action and shape of the impeller blades 25. In the multi-stage unit the various zones of the impeller as shown in FIG. 9, are physically separate. The lowest zone 40 is physically separated from zone 41 immediately above which is the stator zone 41. Immediately above this is the negative dihedral section.

The chamber 22 instead of being a truncated cone, is truncated in the zone 40 portion only, i.e., the intake zone. The helix of the impeller portion **14*b* is at a higher pitch. The motor drive shaft is a multi-sleeve around the center shaft 12, and is so coupled that the upper or negative dihedral portion 14*d* can be rotated separately, or the helix portion 14*b* can be rotated separately as they can be operated together. This requires only standard connections. The middle or stator section 14*c* remains stationary at all times. The higher helix of portion 14*b* causes greater turbulence than if the helix were flatter, but in all the zones operates precisely in the same manner as described for the unified impeller 14. However, the multi-stage unit has the great advantage not heretofore accomplished in that if the negative dihedral zone 42 vanes 14*d* alone are operated the speed of the forward propulsion will be greatly reduced so as to permit trolling or slow forward motion. The maximum speed, of course, is produced when impeller portions 14*d* and 14*b*** are rotated together.

Figure 8:
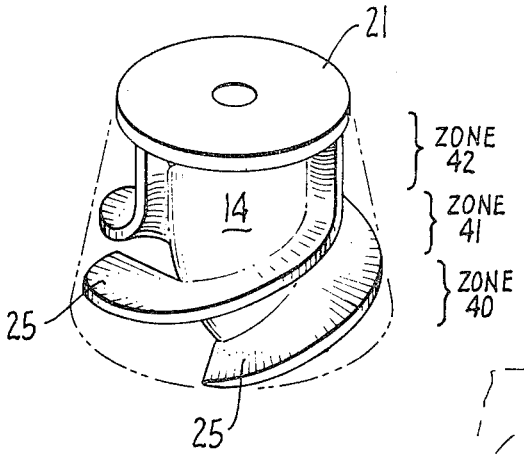
FIG. 8 is a perspective view of a variant form of impeller.

In FIG. 8 there is shown another form of impeller in which the helix of intake zone 40 is flatter. The stator or straightening zone 41 is shorter and the negative dihedral zone of linear force is greater in proportion to the others.

All of the advantageous features are involved in and accomplished by any structure whether it be a unit impeller or a multiple stage impeller.

Figure 11:
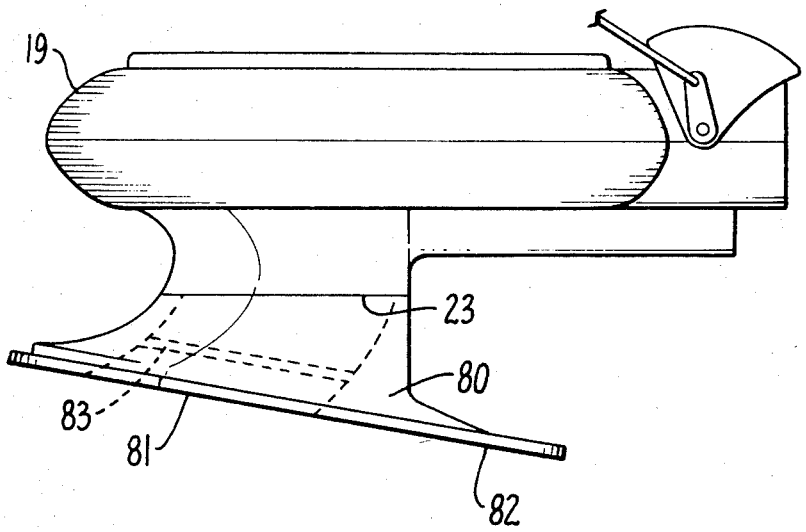
FIG. 11 is a side elevation of the complete power unit with a planing intake member.
Figure 11A:
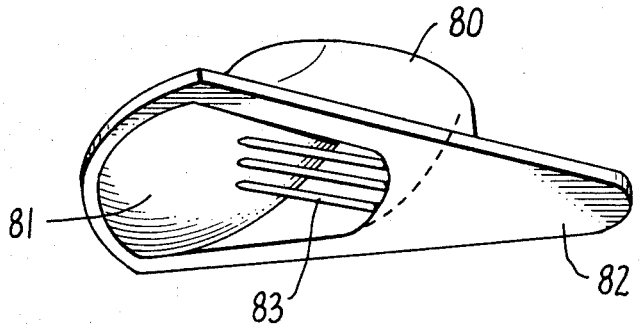
FIG. 11*a* is a perspective view of the planing intake member.

Referring now to FIG. 11 and FIG. **11*a* there is shown a side elevational view of the standard housing 19 with a planing attachment 80 shown in perspective in FIG. 11*a*, secured to the inlet opening 23. This planing attachment has an inlet opening 81 with sides which slope upwardly to mate with the inlet opening 23. Secured to or made a part of the portion 80 is a flat plate 82 which is sloped upwardly toward the boat 16 at a suitable angle to cause a planing effect, i.e., to form an upwardly pushing force toward the boat when the device is being operated. As in all of the operations of this equipment, there is a screen 83 adjacent the inlet 81 to keep out debris and large objects which would or might injure the impeller blades 25. The suction is so heavy in some instances that the pulling of the large amount of liquid into the inlet 23 tends to lower the unit 13 and pull the boat downwardly in the water. The planing effect of the plate 82 counteracts this and keeps the power unit in the normal operating position as described in connection with FIG. 1**.

Figure 12:
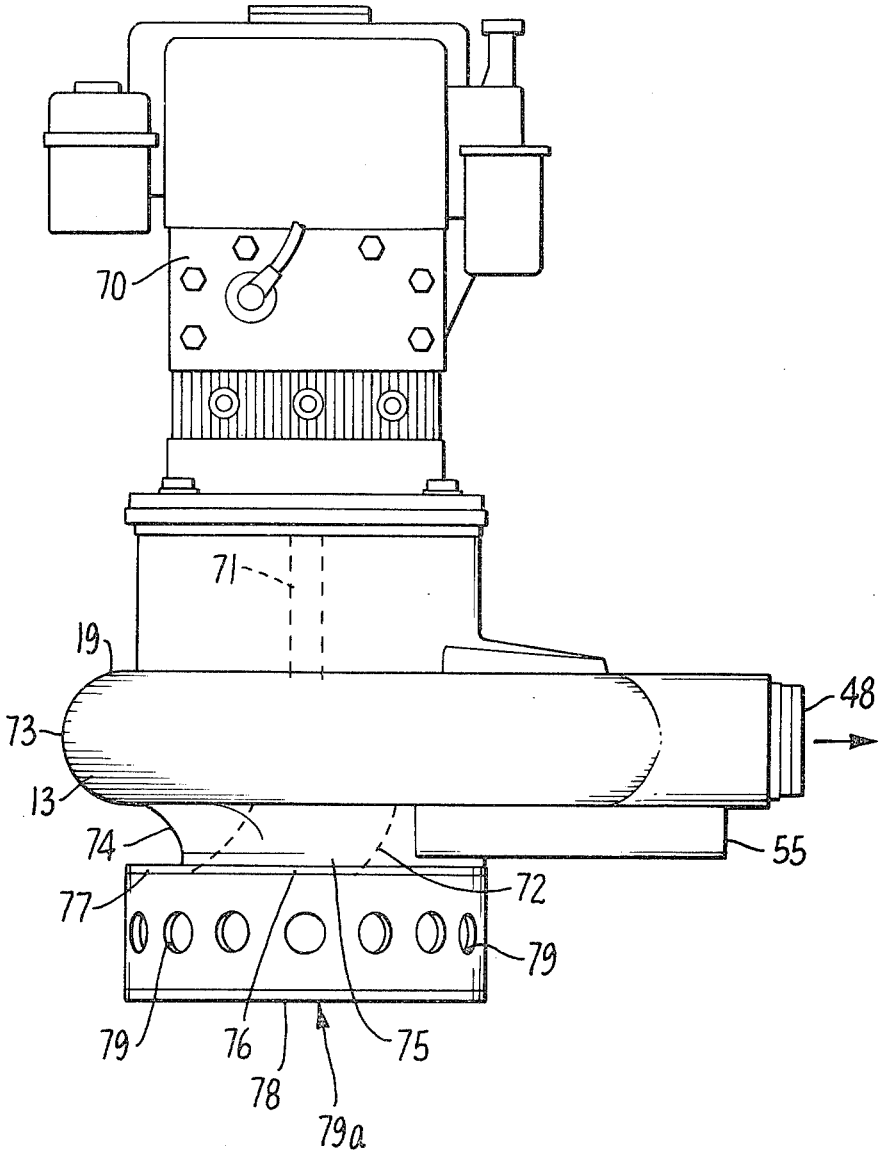
FIG. 12 is an elevational view of the complete stationary power unit.

Referring now to FIG. 12 there is shown an adaptation of the present invention to a stationary installation. Instead of the outboard motor there is a low horsepower standard engine 70, such as a Briggs and Stratton engine. The drive shaft 71 is suitably journaled and coupled to the impeller 14 in the housing 19 of the propulsion unit 13, containing the identical operating structures as shown in FIG. 2 with the outlet at 48. The form of the lower portion of the housing 19 is somewhat different in that the lower end on the intake side has an oval casting which replaces the solid metal portion 72 below the channel 44 and its outer wall 73. The opposite end of the solid metal portion 72 is streamlined as at 74 to reduce the solid metal section. As shown in FIG. 12 the inner wall of the intake 75 is curved as illustrated and has a correspondingly open aperture 76 in adaptor plate 77.

The intake is a ring-like structure 78 which is removably secured with the adaptor plate 77 to the inlet 23 and has radial apertures 79 through its side wall, spaced throughout the entire circumference. The ring 78 is closed by a solid plate **79*a***. This effectively prevents downward suction.

The rotation of the impeller 14 within the housing 19 pulls the water or other fluid in through the radial apertures 79 up through the aperture 76 where the blades 25 of the impeller 14 meet the inflow. The operation and delivery of the fluid at the outlet 48 is precisely as described before. There are numerous uses for such equipment and this low horsepower unit is admirably suited for these services.

It will be observed that the impeller is an important portion of this invention and structure, whether the use is stationary or mobile in jet propulsion uses. It should be apparent that although the descriptive portions herein have referred to and shown a three-blade impeller, the impeller is not restricted to three blades 25, but has many useful operations with two or more vanes depending upon the service required.

Furthermore, as shown herein and especially with reference to FIG. 12, the jet unit is easily adapted for pumping purposes and can handle even colloids and viscous liquids such as mud, concrete and other relatively heavy flows.

The versatility of this structure demonstrates that the purposes and advantages mentioned earlier are achieved as well as others which will readily become apparent to any user.

I claim:

1. A jet propulsion unit for coupling to a conventional power source having a drive shaft, a housing for said unit having a chamber in axial alignment with said drive shaft, said chamber being in the shape of a truncated cone for substantially the first portion of its height with the widest diameter being at the inlet which is open to receive fluid and continuing upwardly into a cylindrical shape for the remainder of its enclosure, a tangential outlet passage from the uppermost portion of said cylindrical portion of said chamber, an outlet tubular passage in said housing cooperating with said tangential outlet said tubular passage having an exhaust outlet, and impeller conforming in structure to the shape of the said chamber connected to said drive shaft for rotation in said chamber, said impeller having a plurality of radially offset blades shaped in a true helix for the first cone shaped portion of said chamber continuously passing to transition curves for the second and beginning of the cylindrical portion of said chamber with continuously substantially vertical radial blade portions for the said cylindrical portion of the chamber.

2. The jet propulsion unit of claim 1 wherein the chamber is formed in two continuous portions, the first one-third of which is the truncated cone portion and the last two-thirds being the cylindrical portion.

3. The jet propulsion unit of claim 1 wherein the exhaust outlet from said tubular passage of said housing lies in a transverse radial plane with respect to the axis of the said drive shaft.

4. The jet propulsion unit of claim 1 wherein the power source is an internal combustion engine and the housing is provided with an internal second chamber having an inlet and an outlet, a passage for connection with and conveying the engine exhaust from said power source to said second chamber, said outlet being provided with an exhaust passage for conveying said engine exhaust for release externally of said housing.

5. The jet propulsion unit of claim 1 wherein the power source is a liquid cooled internal combustion engine and wherein there is a small outlet in the upper portion of the cylindrical wall of the chamber relatively opposite to the main outlet therefrom, a passage in said housing for conveying a relatively small amount of liquid therethrough and a connection to said passage externally of said housing for connecting the same with the cooling passages for said engine.

6. The jet propulsion unit of claim 1 wherein the internal wall of the outlet tubular passage of the housing at the discharge opening from the upper portion of the chamber is sharpened to provide a cutoff and direction means for the flow of fluid into said passage.

7. A jet propulsion unit of claim 1 adapted for multistage operation wherein the impeller comprises three separate portions the first being the helical portion mounted on said drive shaft, means on said drive shaft for rotating the same in said chamber either independently from or in conjunction with the separate third portion, means on said drive shaft for rotating the said third portion either independently from or in conjunction with the said first portion, and means for maintaining the said second portion stationary during rotation.

* * * * *